US008480263B1

(12) United States Patent
Sung

(10) Patent No.: US 8,480,263 B1
(45) Date of Patent: Jul. 9, 2013

(54) HEAT DISSIPATION STRUCTURE OF LIGHTING DEVICE

(76) Inventor: Wen-Kung Sung, Taipei (TW)

( * ) Notice: Subject to any disclaimer, the term of this patent is extended or adjusted under 35 U.S.C. 154(b) by 0 days.

(21) Appl. No.: 13/396,837

(22) Filed: Feb. 15, 2012

(51) Int. Cl.
*F21V 29/00* (2006.01)

(52) U.S. Cl.
USPC ..... 362/294; 362/373

(58) Field of Classification Search
USPC ..... 362/294, 373
See application file for complete search history.

(56) References Cited

U.S. PATENT DOCUMENTS 8,011,808 B2 * 9/2011 Liu ..... 362/294
8,053,960 B2 * 11/2011 Liu et al. ..... 313/46
8,277,082 B2 * 10/2012 Dassanayake et al. .. 362/249.02
2005/0265000 A1 * 12/2005 He ..... 361/709
2010/0188860 A1 * 7/2010 Liaw ..... 362/373
2010/0264799 A1 * 10/2010 Liu et al. ..... 313/46

* cited by examiner

*Primary Examiner* — Peggy A. Nelis
(74) *Attorney, Agent, or Firm* — Bacon & Thomas, PLLC

(57) ABSTRACT

A heat dissipation structure includes a base, a light emission module, a heat dissipation module, and a control circuit module. The base has two ends respectively forming an electrical connector section and an open cavity. The light emission module includes a substrate mounted in the open cavity and a plurality of light emission elements mounted on the substrate. The heat dissipation module includes a plurality of heat dissipation plates stacked on the substrate to form a concentrated heat dissipation zone. Each heat dissipation plate has a circumference forming a plurality of included side wing sections. The side wing sections of different heat dissipation plates have different inclination angle and form an expanded heat dissipation zone. The control circuit module is received in the base and is electrically connected to the substrate and the electrical connector section.

10 Claims, 9 Drawing Sheets

HEAT DISSIPATION STRUCTURE OF LIGHTING DEVICE

FIELD OF THE INVENTION

The present invention relates to a heat dissipation structure of lighting device, and in particular to a heat dissipation structure applicable to lighting fixtures and automobile lights.

BACKGROUND OF THE INVENTION

A light-emitting diode (LED) features lightweight and small size and are thus widely used in the today's lighting fixtures. However, a single light-emitting diode has only very limited lighting performance, and thus, the known lighting fixture often adopt a light-emission module that is composed of a number of LEDs. Further, to increase the brightness of light, high brightness LEDs must be used. In addition, to expand the lighting scope, the number of LEDs used must be increased. For whatever structure that may be used, the amount of heat generated is inevitably increased. The known lighting fixture is often equipped with a heat dissipation structure that is made of aluminum extrusions or die castings, both being integrally formed structures, making it difficult to reduce the overall thickness and weight. As a consequence, for the known lighting fixtures, the material used to make the heat dissipation structure cannot be reduced and cost is hard to lower down. Further, once such a heat dissipation structure is incorporated in a light fixture, the overall weight is increased.

In view of the above discussed issue, the present invention aims to provide a heat dissipation structure for lighting device, which provides an effect of separating heat and electricity and also realize sectionized heat dissipation so as to offer an excellent performance of efficient and effective heat dissipation and also allows of recycling and reuse and reduction of weight, thereby lowering down cost.

SUMMARY OF THE INVENTION

An objective of the present invention is to provide a heat dissipation structure of lighting device that features efficient and effective heat dissipation, in which the heat dissipation structure is divided into a central fast heat conduction zone and a circumferential large-area heat dissipation zone to achieve an effect to sectionized heat dissipation for increasing heat dissipation area and improving heat dissipation performance.

Another objective of the present invention is to provide a heat dissipation structure of lighting device that features separated arrangements for heat and electricity, whereby by setting up a heat dissipation module for transfer of heat in an independent manner, the influence of thermal energy that is being transferred on electrical operations of a light emission module and a control circuit module can be alleviated.

A further objective of the present invention is to provide a heat dissipation structure of lighting device that is of a low manufacturing cost, wherein a heat dissipation structure that is made in a modularized form and is composed of a plurality of stacked heat dissipation plates that features light weight and small size is different from the integrally formed known heat dissipation structure and helps ease dismounting and replacement operation and can be recycled and reused and shows an effect of reducing weight so as to achieve an effect of lowering down cost.

To achieve the above objectives, the present invention provides a heat dissipation structure of lighting device, which comprises: a base, which has an end forming an electrical connector section and an opposite end forming an open cavity; a light emission module, which comprises a substrate and a plurality of light emission elements, the substrate being mounted in the open cavity of the base, the light emission elements being mounted on a surface of the substrate; a heat dissipation module, which comprises a plurality of heat dissipation plates, the heat dissipation plates being arranged in a stacked manner on an opposite surface of the substrate and located inside the base, whereby the heat dissipation module forms a concentrated heat dissipation zone with the heat dissipation plates, each of the heat dissipation plates having a circumference along which a plurality of inclined side wing sections is circumferentially distributed, two adjacent ones of the side wing sections of each heat dissipation plate forming a first heat dissipation gap therebetween, the side wing sections of an upper one of the stacked heat dissipation plates and the side wing sections of a lower one of the stacked heat dissipation plates being of different inclination angles, a second heat dissipation gap being formed between the side wing sections of the adjacent upper and lower ones of the stacked heat dissipation plates, an expanded heat dissipation zone being formed with the side wing sections that are provided on a perimeter of the heat dissipation module; and a control circuit module, which is received in the base, two ends of the control circuit module being respectively in electrical connection with the substrate and the electrical connector section. As such, an effect of separating heat and electricity from each other is realized. Further, sectionized heat dissipation is provided to realize efficient and effective dissipation of heat and improve heat dissipation performance. Further, the heat dissipation plates of the heat dissipation module adopt a modularized arrangement that facilitates recycling, reuse, and reduction of weight thereby lowering down the expense.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
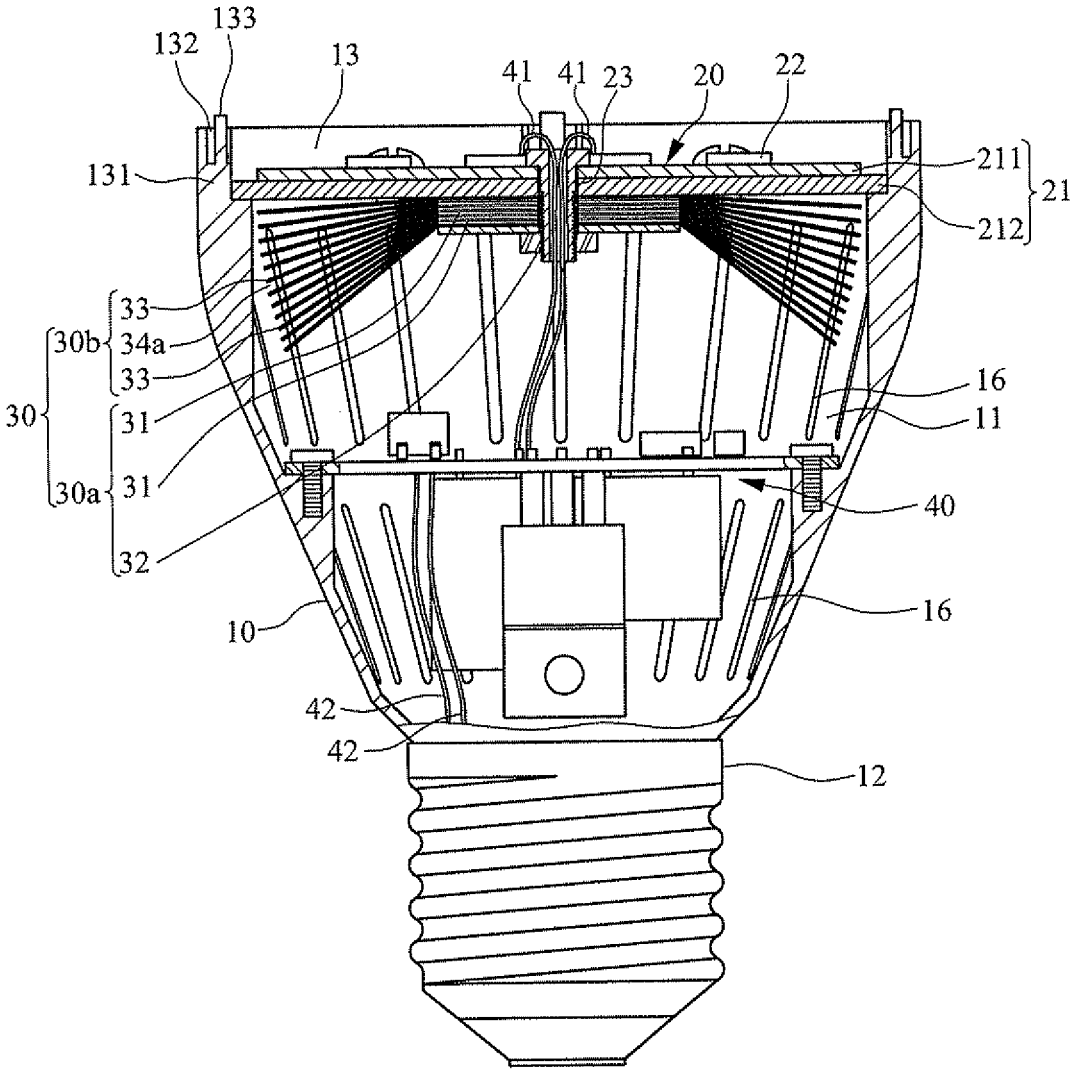
FIG. 1 is a cross-sectional view of a heat dissipation structure of lighting device according to the present invention.

With reference to the drawings and in particular to FIGS. 1-4, a heat dissipation structure that is provided for a lighting device comprises a base 10, a light emission module 20, a heat dissipation module 30, and a control circuit module 40.

The base 10 has an end forming an electrical connector section 12 and the base 10 has an opposite end forming an open cavity 13.

The light emission module 20 comprises a substrate 21 and a plurality of light emission elements 22. The substrate 21 is mounted in the open cavity 13 of the base 10. The light emission elements 22 are mounted on a surface of the substrate 21.

The heat dissipation module 30 comprises a plurality of heat dissipation plates 31. The heat dissipation plates 31 are arranged, in a stacked manner, on an opposite surface of the substrate 21 and are located inside the base 10, whereby the heat dissipation module 30 forms a concentrated heat dissipation zone 30*a* with the heat dissipation plates 31. Each of heat dissipation plates 31 has a circumference along which a plurality of inclined side wing sections 33 is circumferentially distributed. Two adjacent ones of the side wing sections 33 of each heat dissipation plates 31 form therebetween a first heat dissipation gap 34*b*. The side wing sections 33 of an upper one of the stacked heat dissipation plates and the side wing sections 33 of a lower one of the stacked heat dissipation plates are of different inclination angles, whereby a second heat dissipation gap 34*a* is formed between the side wing sections 33 of the adjacent upper and lower ones of the stacked heat dissipation plates 31 and an expanded heat dissipation zone 30*b* is formed with the side wing sections 33 that are provided on a perimeter of the heat dissipation module 30.

The control circuit module 40 is received in the base 10 and opposite ends of the control circuit module 40 are respectively in electrical connection with the substrate 21 and the electrical connector section 12.

In an embodiment, the present invention sets up the heat dissipation module 30 that is provided for dissipation of heat in an independent manner in order to have thermal conduction components and the electrical conduction components arranged in a separated manner to realize separation of heat and electricity. Further, the heat dissipation module 30 is divided into a concentrated heat dissipation zone 30*a* and an expanded heat dissipation zone 30*b*, by which sectionized heat dissipation can be achieved. The heat dissipation plates 31 and the side wing sections 33 thereof that construct the heat dissipation module 30 are structured in a modularized manner to achieve the purposes of reducing weight and thickness, and each a heat dissipation plates 31 can be recycled and reused to thereby save material and lower down cost. Further, the heat dissipation plates 31 of the present invention are made of aluminum plates. Since the heat dissipation plates 31 can be made of the standardized products of aluminum plate that are readily available in the market, the advantages of easy availability, low cost, easy manufacturing, and light weight can be achieved to thereby significantly lower down the expense.

Referring to FIGS. 1, 1A, 1B, and 10, the side wing sections 33 of the heat dissipation plates 31 are made in a scallop shape, whereby the first heat dissipation gap 34*b* between adjacent side wing sections 33 of each heat dissipation plate 31 is convergent from an inner end (being close to a central web of the heat dissipation plate 31) toward an outer end (being an outer edge of the side wing sections 33). Thus, when the plurality of heat dissipation plates 31 is stacked, a plurality of first heat dissipation gaps 34*b* that aligns in the same row forms a longitudinally extending heat dissipation channel (not shown) through which air is allowed to flow. Further, since the side wing sections 33 that are located at different altitudes in the heat dissipation module 30 have different inclination angles (for example the inclination of the side wing sections 33 being larger for a heat dissipation plate 31 at a lower altitude, this meaning the side wing sections showing an increased angle of being bent downward with respect to the web portion), the second heat dissipation gap 34*a* that is formed between the side wing sections 33 of adjacent upper and lower heat dissipation plates 31 of the stack is convergent from an outer end (being the outer circumference of the expanded heat dissipation zone 30*b*) toward an inner end (being close to the concentrated heat dissipation zone 30*a*). In this arrangement, the heat dissipation plates 31 located in the concentrated heat dissipation zone 30*a* are tightly stacked to thereby form a shortest thermal conduction path that conducts away and thus dissipates the thermal energy generated by the light emission module 20. The side wing sections 33 that are located in the expanded heat dissipation zone 30*b* are arranged in a spaced manner and the second heat dissipation gap 34*a* present between the side wing sections 33 of different altitudes form a lateral heat dissipation channel through which air is allowed to flow. The lateral heat dissipation channels and the plurality of longitudinal heat dissipation channels discussed above collectively form a grid configuration (not explicitly shown in the drawings), which helps increase heat dissipation area and also helps air to flow to dissipate thermal energy from the concentrated heat dissipation zone 30*a* in a sideway manner thereby improving the performance of heat dissipation.

Figure 1A:
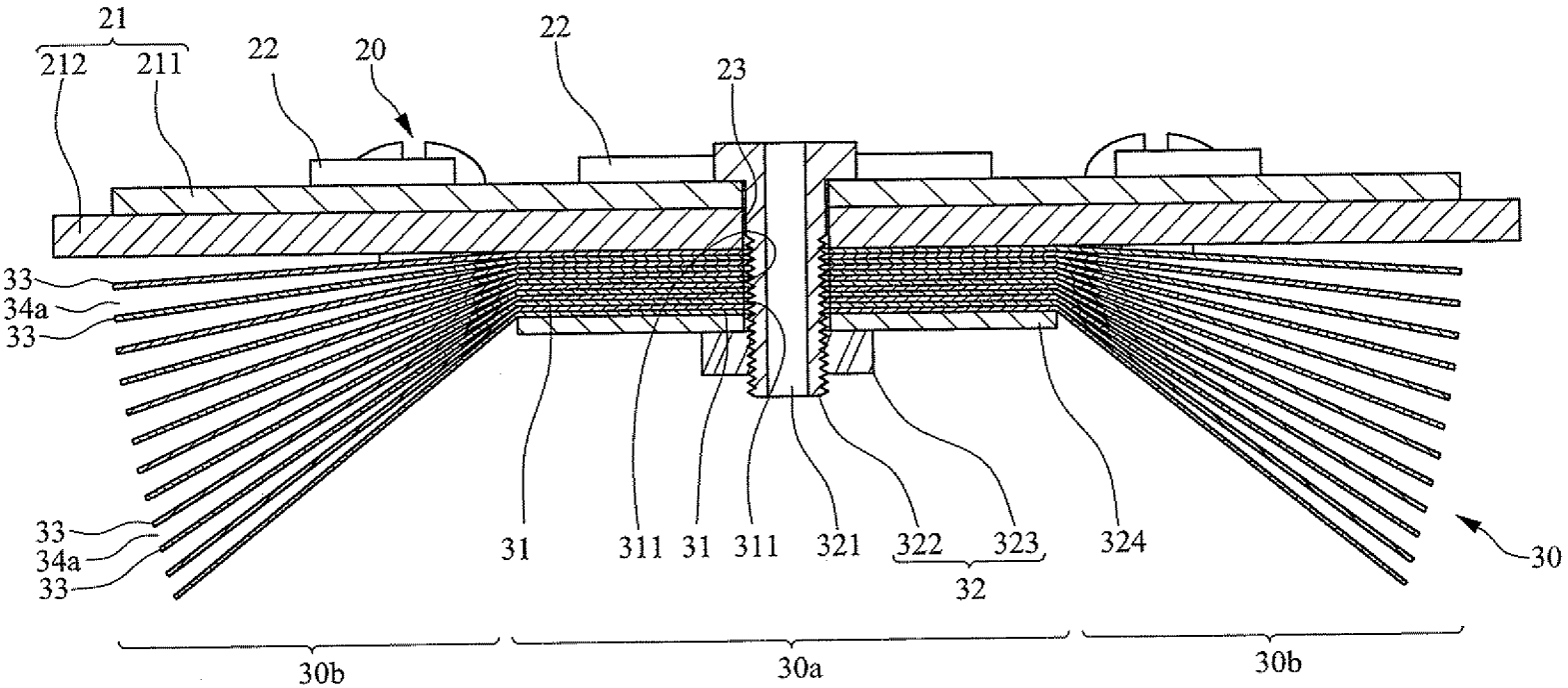
FIG. 1A is an enlarged view showing a heat dissipation module in combination with a light emission module shown in FIG. 1.
Figure 1B:
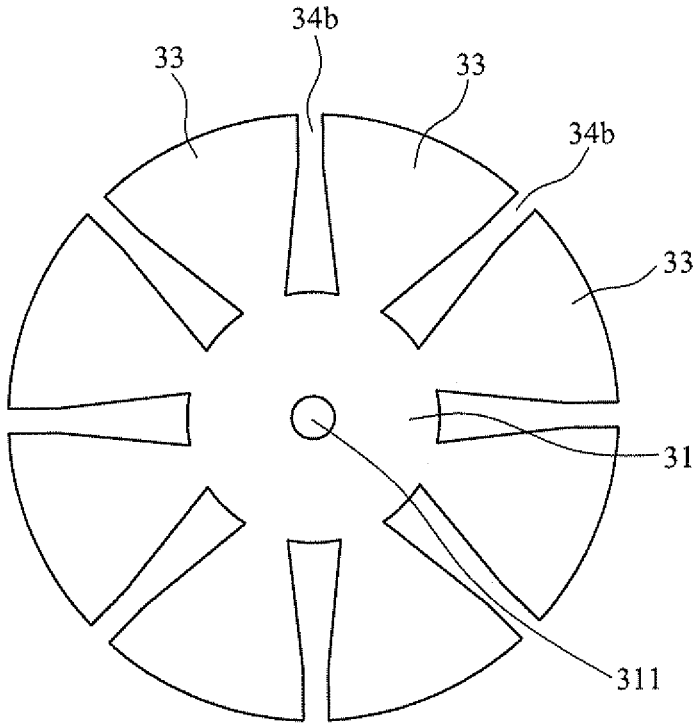
FIG. 1B is a top plan view of a heat dissipation plate according to the present invention.
Figure 1C:
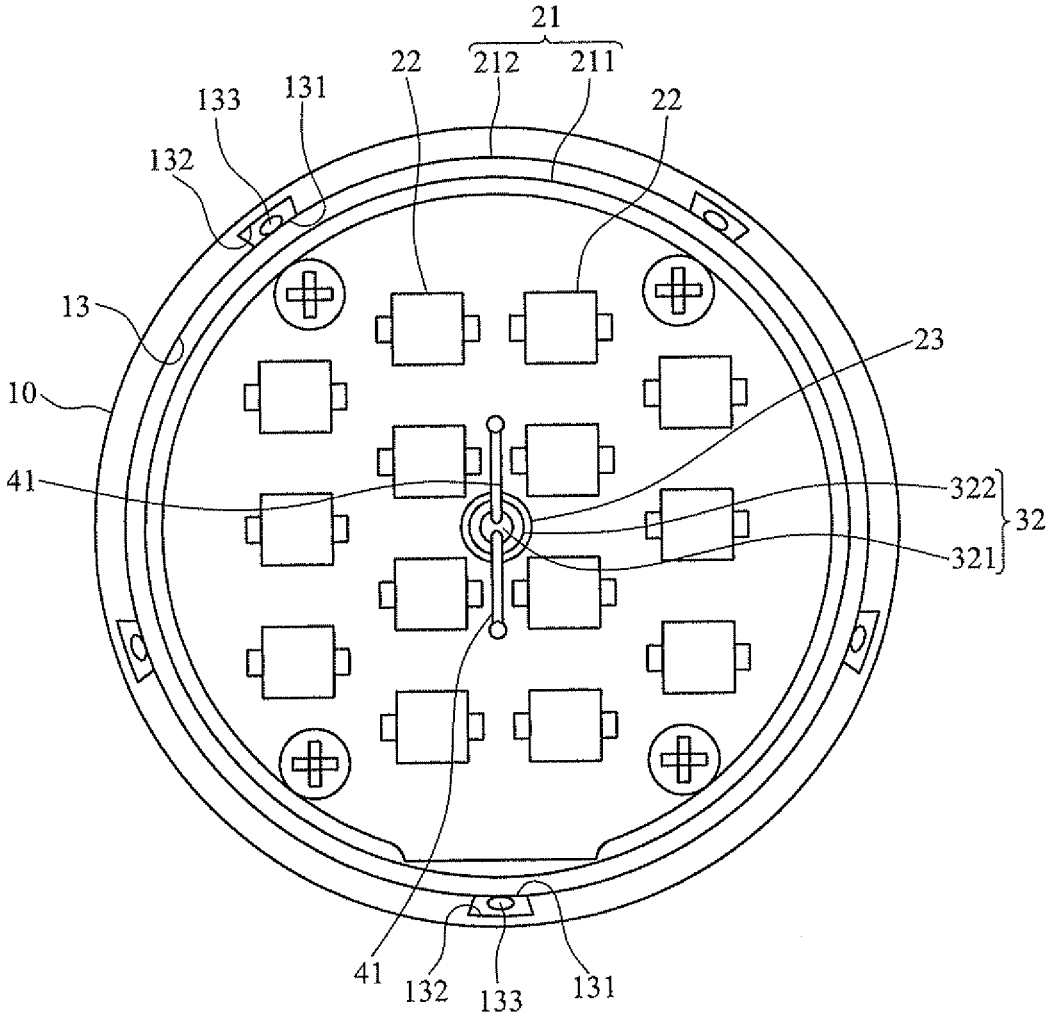
FIG. 1C is a top plan view of FIG. 1.

Referring to FIGS. 1, 1A, and 1C, the substrate 21 comprises a positioning section 23 and each of the heat dissipation plates 31 forms a through hole 311. The through holes 311 and the positioning section 23 are arranged to align with each other. The heat dissipation module 30 further comprises at least one fastening unit 32 that forms a bore 321. The fastening unit 32 is received through and fixed in the positioning section 23 of the substrate 21 and also extends through the through holes 311 of the heat dissipation plates 31. The control circuit module 40 comprises a pair of first leads 41 and a pair of second leads 42. The first leads 41 extend through the bore 321 of the fastening unit 32 and the positioning section 23 of the substrate 21 to electrically connect to the substrate 21. The second leads 42 are electrically connected to the electrical connector section 12 of the base 10. The positioning section 23 is embodied as a through hole to receive fast insertion of the fastening unit 32 and position and fix of the fastening unit.

Referring to FIG. 1A, the fastening unit 32 comprises a male fastening element 322 (such as a screw or a bolt) in which the bore 321 is formed, a female fastening element 323 (such as a nut), and a washer 324. The male fastening element 322 has an end positioned on a surface of the substrate 21 and the male fastening element 322 has an opposite end extending through the positioning section 23 of the substrate 21 and the through holes 311 of the heat dissipation plates 31 for engaging the female fastening element 323 to realize adjustment of position. The washer 324 is located between the female fastening element 323 and the heat dissipation plates 31 for tight engagement. The present invention uses a removable male fastening element 322 in combination with a female fastening element 323 to allow of arbitrary increase or decrease the number of the heat dissipation plates 31 that constitutes the heat dissipation module 30 so as to easily accommodate any type of light emission module 20.

The substrate 21 comprises a circuit board 211 and a support board 212. The circuit board 211 receives the light emission elements 22 mounted thereon to be in electrical connection with the circuit board 211 and is electrically connected to the first leads 41 of the control circuit module 40. The support board 212 is arranged between the circuit board 211 and the heat dissipation plates 31 to be inlaid in the open cavity 13. The support board 212 is made of a thermally conductive material (such as aluminum) to helps transfer of heat. The circuit board 211 is coupled to the support board 212 by a plurality of fasteners (such as screws). In this way, a modularized arrangement is formed to facilitate mounting/dismounting and replacement of the circuit board 211. Corresponding through holes are defined in the centers of the circuit board 211 and the support board 212 for the formation of the positioning section 23 of the substrate 21.

Figure 2:
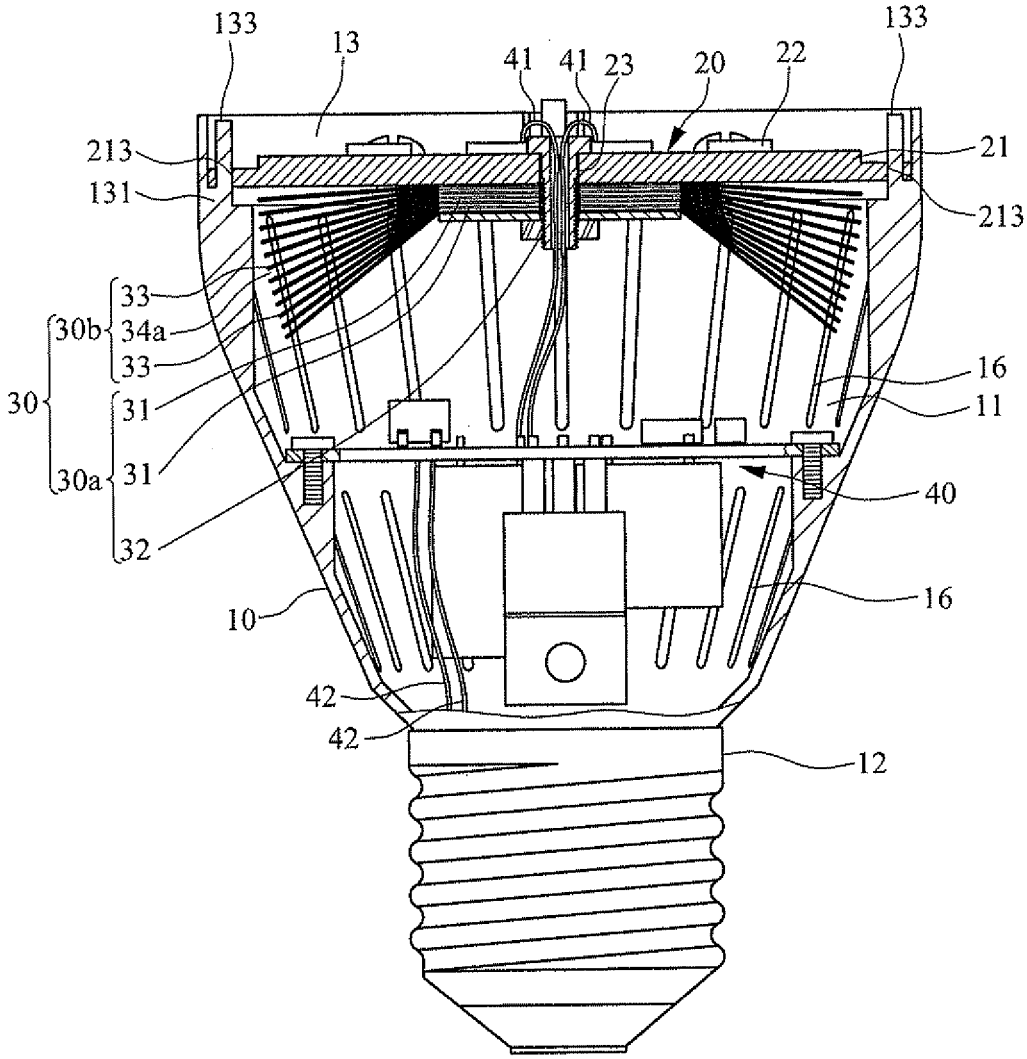
FIG. 2 is a cross-sectional view in which the substrate of FIG. 1 is formed as a circuit board that forms positioning slots in a circumferential edge thereof to correspond to tenons formed along a circumference of an open cavity.
Figure 2A:
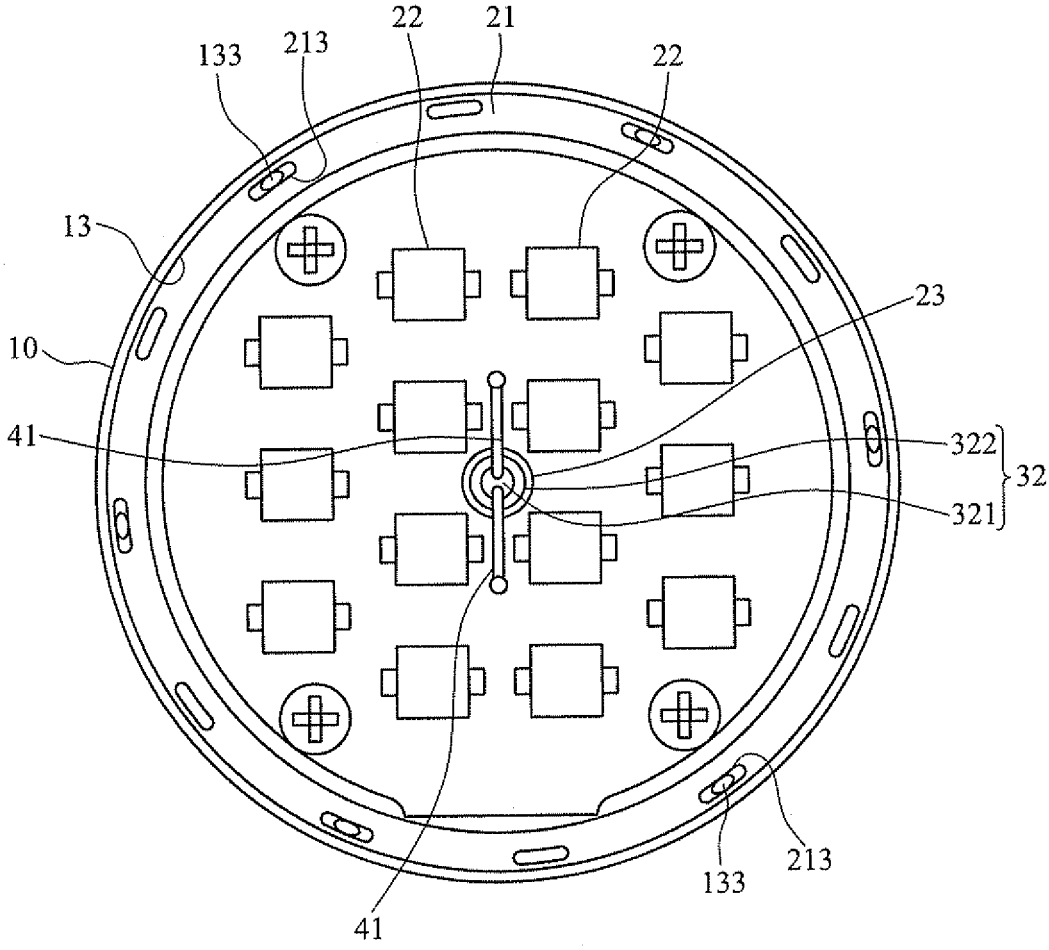
FIG. 2A is a top plan view of FIG. 2.

The substrate 21 is not limited to such an embodiment. Referring to FIGS. 2 and 2A, the substrate 21 can be of a structure of circuit board on which a circuit is formed in order to directly and fast transmit thermal energy to the heat dissipation module 30. The substrate 21 forms a plurality of circumferentially distributed positioning slots 213 adjacent to a circumferential edge thereof. A plurality of tenons 133 is circumferentially distributed along a circumference of the open cavity 13 of the base 10. The tenons 133 are respectively corresponding in position to the positioning slots 213 to help the substrate 21 to fast inlay and fix in the open cavity 13 and also facilitate adjustment of position. The positioning slots 213 may alternatively formed in the support board 212 adjacent to a circumferential edge thereof (not shown in the drawings).

The base 10 forms therein a receiving chamber 11 communicating with the open cavity 13 in order to provide a distance between the heat dissipation module 30 and the control circuit module 40 to help air to flow therethrough. The base 10 has a circumferential side wall in which a plurality of heat dissipation holes 16 (see FIG. 1) is circumferentially distributed and also in communication with the receiving chamber 11 to thereby help air ventilation between inside and outside of the base 10 and to fast discharge the thermal energy transmitted to the concentrated heat dissipation zone 30*a*, the hot air remaining in the gaps of the expanded heat dissipation zone 30*b*, and the thermal energy generated by the control circuit module 40 out of the base 10.

Figure 3:
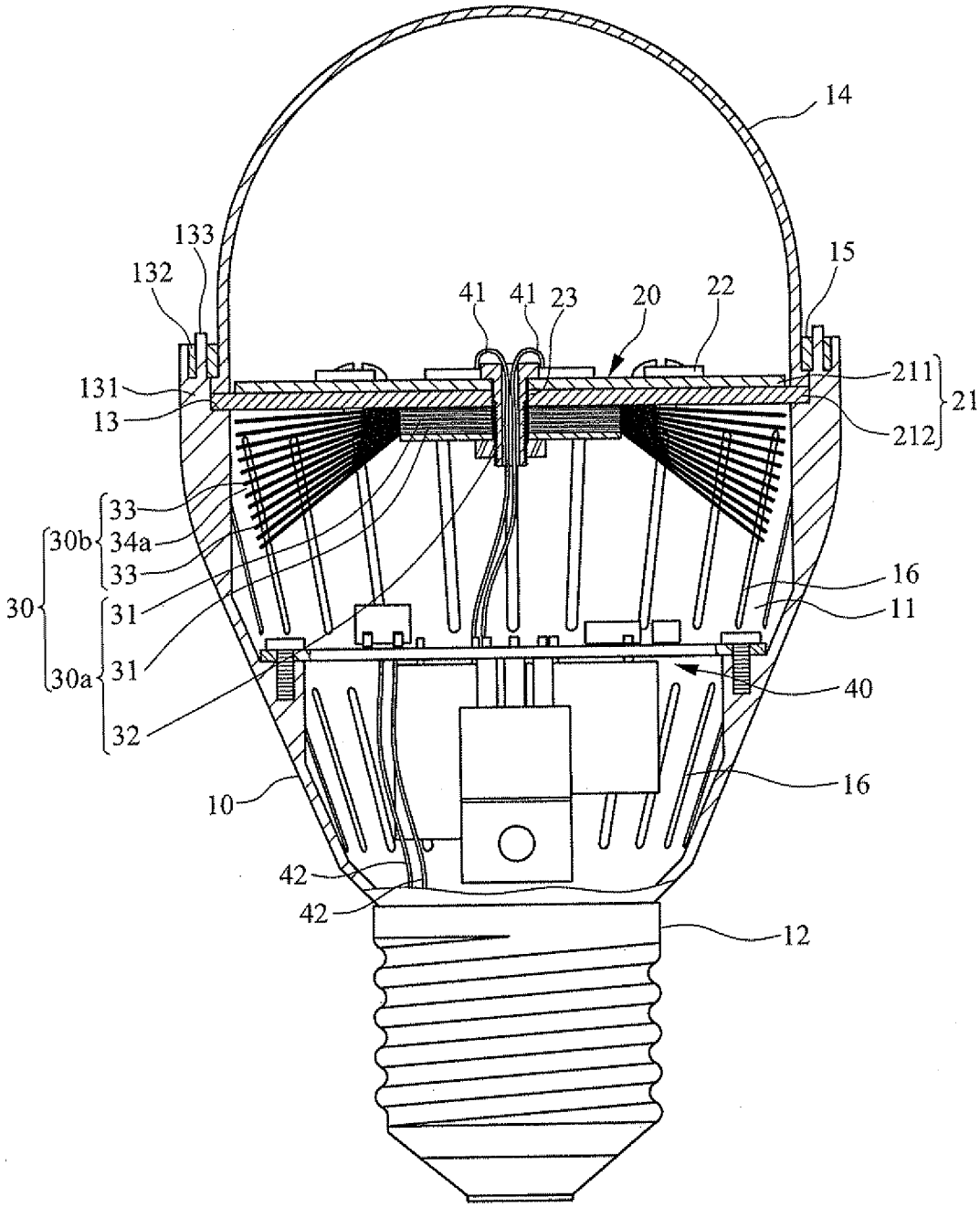
FIG. 3 is a cross-sectional view showing an embodiment that further adds a cover and a coupling ring to the embodiment of FIG. 1.
Figure 3A:
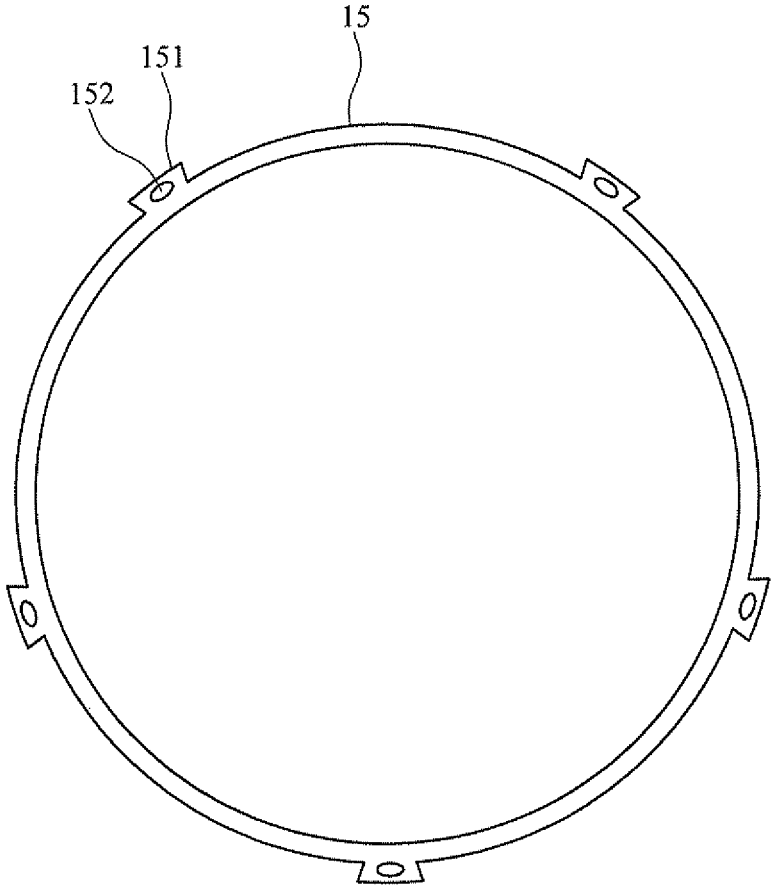
FIG. 3A is a top plan view of the coupling ring according to the present invention.
Figure 4:
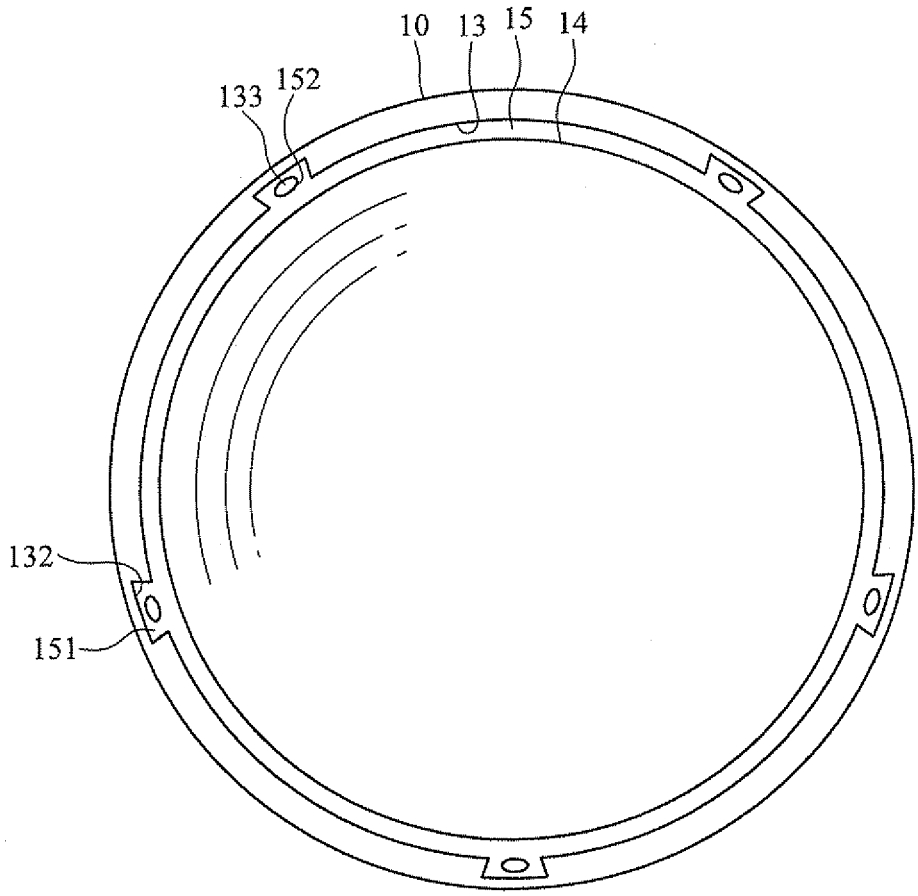
FIG. 4 is a top plan view of FIG. 3.

Further, referring to FIGS. 3, 3A, and 4, the base 10 is further combined with a cover 14 and a coupling ring 15. The cover 14 has an edge that is received in the open cavity 13 to be positioned on the circumferential edge of the substrate 21. The coupling ring 15 retains the cover 14 in the open cavity 13 of the base 10. A plurality of recess 132 (such as dovetailed slots) and a plurality of tenons 133 are formed circumferentially along the circumference of the open cavity 13 of the base 10 and each of the recesses 132 is coupled therein a raised block 131 (see reference 131 of FIGS. 1 and 2) to correspond to and mate recesses formed in the circumference of the substrate 21 for positioning and fixing. The tenons 133 are respectively provided in the recesses 132 and located on the raised blocks 131. The coupling ring 15 forms a plurality of projection blocks 151 (such as dovetailed blocks) and a plurality of tenon holes 152 circumferentially distributed along a circumference thereof. The tenon holes 152 extend through the projection blocks 151. The recesses 132 respectively correspond to and mate the projection blocks 151 to allow the tenons 133 to be received through the tenon holes 152, thereby allowing the edge of the cover 14 to be retained by the coupling ring 15.

As described above, the base 10 can be embodied as a metal base or a plastic base. The base 10, together with the cover 14 and the coupling ring 15, can be selectively made of plastics to effectively reduce the weight. The electrical connector section 12 of the base 10 can be made in the form of a removable metal collar or metal pins (for soldering purposes) in order to ease connection with an external power source. The heat dissipation plates 31 can be made of metal materials, such as aluminum and copper. Aluminum is preferred for its advantageous reduction of weight. The light emission elements 22 of the light emission module 20 can be embodied as light-emitting diodes. The control circuit module 40 is composed of a circuit board and electronic components mounted to the circuit board to supply electrical power to the light emission module 20 and to control the operation of the light emission elements 22.

As such, the present invention provides an arrangement of combination of a base 10, a light emission module 20, a heat dissipation module 30, and a control circuit module 40 in such a way to effectively separate heat and electricity. Further, the heat dissipation module 30 provides sectionized heat dissipation to improve the performance of heat dissipation. Further, the heat dissipation plates 31 of the heat dissipation module 30 adopt a modularized arrangement that facilitates recycling, reuse, and reduction of weight thereby lowering down the expense.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A heat dissipation structure for lighting device, comprising:

a base, which has an end forming an electrical connector section and an opposite end forming an open cavity;

a light emission module, which comprises a substrate and a plurality of light emission elements, the substrate being mounted in the open cavity of the base, the light emission elements being mounted on a surface of the substrate;

a heat dissipation module, which comprises a plurality of heat dissipation plates, the heat dissipation plates being arranged in a stacked manner on an opposite surface of the substrate and located inside the base, whereby the heat dissipation module forms a concentrated heat dissipation zone with the heat dissipation plates, each of the heat dissipation plates having a circumference along which a plurality of inclined side wing sections is circumferentially distributed, two adjacent ones of the side wing sections of each heat dissipation plate forming a first heat dissipation gap therebetween, the side wing sections of an upper one of the stacked heat dissipation plates and the side wing sections of a lower one of the stacked heat dissipation plates being of different inclination angles, a second heat dissipation gap being formed between the side wing sections of the adjacent upper and lower ones of the stacked heat dissipation plates, an expanded heat dissipation zone being formed with the side wing sections that are provided on a perimeter of the heat dissipation module; and a control circuit module, which is received in the base, two ends of the control circuit module being respectively in electrical connection with the substrate and the electrical connector section.

2. The heat dissipation structure as claimed in claim 1, wherein the side wing sections of the heat dissipation plates are made in a scallop shape, whereby the first heat dissipation gap between adjacent ones of the side wing sections of each of the heat dissipation plates is convergent from an inner end toward an outer end and the second heat dissipation gap formed between the side wing sections of adjacent upper and lower ones of the stacked heat dissipation plates is convergent from an outer end toward an inner end.

3. The heat dissipation structure as claimed in claim 1, wherein the heat dissipation plates located in the concentrated heat dissipation zone are tightly stacked and the side wing sections located in the expanded heat dissipation zone are arranged in a spaced manner.

4. The heat dissipation structure as claimed in claim 1, wherein the substrate comprises a positioning section and each of the heat dissipation plates forms a through hole, the through holes and the positioning section being arranged to align with each other, the heat dissipation module comprising at least one fastening unit that forms a bore, the fastening unit being received through and fixed in the positioning section of the substrate and also extending through the through holes of the heat dissipation plates, the control circuit module comprising a pair of first leads and a pair of second leads, the first leads extending through the bore of the fastening unit and the positioning section of the substrate to electrically connect to the substrate, the second leads being electrically connected to the electrical connector section of the base.

5. The heat dissipation structure as claimed in claim 4, wherein the fastening unit comprises a male fastening element in which the bore is formed, a female fastening element, and a washer, the male fastening element having an end positioned on a surface of the substrate and an opposite end extending through the positioning section of the substrate and the through holes of the heat dissipation plates for engaging the female fastening element to realize adjustment of position, the washer being located between the female fastening element and the heat dissipation plates.

6. The heat dissipation structure as claimed in claim 1, wherein the substrate comprises a circuit board and a support board, the support board being between the circuit board and the heat dissipation plates, a plurality of positioning slots being circumferentially distributed in the support board to be adjacent to a circumference edge thereof, a plurality of tenons being circumferentially distributed along a circumference of the open cavity of the base, the tenons respectively corresponding to the positioning slots to help the support board of the substrate to fast inlay and fix in the open cavity, the circuit board being coupled to the support board by a plurality of fasteners.

7. The heat dissipation structure as claimed in claim 1, wherein the substrate is of a structure of circuit board on which a circuit is formed, the substrate forming a plurality of circumferentially distributed positioning slots adjacent to a circumferential edge thereof, a plurality of tenons being circumferentially distributed along a circumference of the open cavity of the base, the tenons respectively corresponding to the positioning slots to help the substrate to fast inlay and fix in the open cavity.

8. The heat dissipation structure as claimed in claim 1, wherein the base a circumferential wall in which a plurality of heat dissipation holes is circumferentially distributed.

9. The heat dissipation structure as claimed in claim 1, wherein the base is combined with a cover and a coupling ring, the cover having an edge that is received in the open cavity to be positioned on the circumferential edge of the substrate, the coupling ring retaining the cover in the open cavity of the base, a plurality of recess and a plurality of tenons being formed circumferentially along the circumference of the open cavity of the base, each of the recesses being coupled therein a raised block, the tenons being respectively provided in the recesses and located on the raised blocks, the coupling ring forming a plurality of projection blocks and a plurality of tenon holes circumferentially distributed along a circumference thereof, the tenon holes respectively extending through the projection blocks, the recesses respectively corresponding to and mating the projection blocks to allow the tenons to be received through the tenon holes, thereby allowing the edge of the cover to be retained by the coupling ring.

10. The heat dissipation structure as claimed in claim 1, wherein the base is one of a metal base and a plastic base and the heat dissipation plates are plates made of metal.

* * * * *